US005488288A

United States Patent [19]

Elmer

[11] Patent Number: 5,488,288

[45] Date of Patent: Jan. 30, 1996

[54] CIRCUIT ARRANGEMENT INTEGRATED IN A SEMICONDUCTOR CIRCUIT

[75] Inventor: Werner Elmer, Moosburg, Germany

[73] Assignee: Texas Instruments Deutschland GmbH, Germany

[21] Appl. No.: 974,869

[22] Filed: Nov. 12, 1992

[30] Foreign Application Priority Data

Nov. 15, 1991 [DE] Germany ..... 41 37 730.3

[51] Int. Cl.[6] ..... G05F 1/46

[52] U.S. Cl. ..... 323/284; 323/907; 327/362

[58] Field of Search ..... 323/284, 907; 330/256, 289, 307, 253, 277; 327/362, 512

[56] References Cited

U.S. PATENT DOCUMENTS 4,897,613 1/1990 Rao et al. ..... 330/253
5,258,703 11/1993 Pham et al. ..... 323/313

FOREIGN PATENT DOCUMENTS 0046482 3/1982 European Pat. Off. .
0214899 3/1987 European Pat. Off. .
60-195625 10/1985 Japan .
2032659 5/1980 United Kingdom ..... 323/907
2050097 12/1980 United Kingdom .

OTHER PUBLICATIONS

Halbleiter–Schaltungstechnik—U. Tietze et al, 1986 pp. 524–524 by Springer–Verlag, Berlin, Germany.

On–chip voltage regulators with improved ripple rejection'IBM technical disclosure Bulletin, vol. 32, No. 10A, pp. 26–28 Mar. 1990.

*Primary Examiner*—Peter S. Wong
*Assistant Examiner*—Adolf Berhane
*Attorney, Agent, or Firm*—William E. Hiller; Richard L. Donaldson

[57] ABSTRACT

The present invention relates to a circuit arrangement integrated in a semiconductor circuit. In modern microprocessor systems with high clock rates (50 MHz and more) special chips with narrow tolerance ranges as regards their switching speed are required. The circuit arrangement according to the invention compensates the switching speed fluctuations due to temperature fluctuations and process spread by generating an internal operating voltage and controlling said voltage in such a manner that it counteracts the fluctuations of the switching speed due to temperature changes and process spread and compensates said fluctuations.

11 Claims, 4 Drawing Sheets

CIRCUIT ARRANGEMENT INTEGRATED IN A SEMICONDUCTOR CIRCUIT

Figure 1:
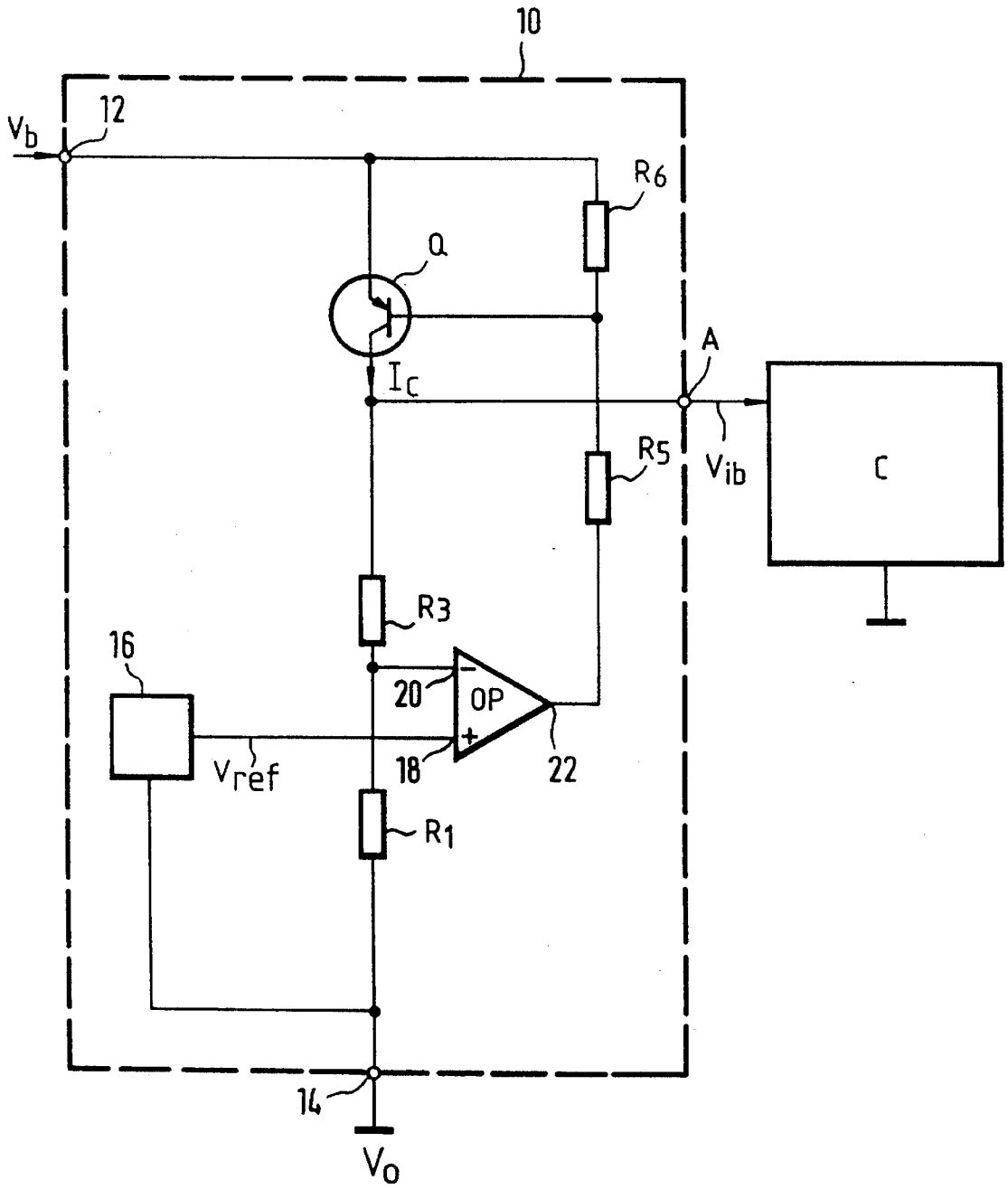
Fig.1 PRIOR ART

The present invention relates to a circuit arrangement integrated in a semiconductor circuit for generating an internal operating voltage for a digital circuit integrated in the same semiconductor substrate with bipolar components and field-effect components from an external supply voltage, the digital circuit having a switching speed variable in dependence upon the operating voltage, comprising an adjustable control circuit for the internal operating voltage.

Essential factors which influence the switching time of CMOS and BIC-MOS circuits and increase or decrease said switching time are the operating voltage, the ambient temperature and the channel length of the transistors contained in the circuits. "Switching time" here is understood to be the delay period which occurs between a change of the input signal of the circuit and a thereby initiated change of the output signal.

However, high demands are made on modules or chips of microprocessor systems as regards their switching times, in particular of clock drivers of such systems: Firstly, various gates accommodated in the package of a clock driver must satisfy narrow switching time tolerances (<0.5 ns).

Secondly, switching times of various chips or modules originating from different fabrication series and consequently subjected to a fabrication process spread must lie within narrow tolerance ranges (<1.0 ns) as regards the switching times. Thirdly, switching times of the chips of modern microprocessor systems with high clock rates should be only slightly influenced by temperature fluctuations and fluctuations in the operating voltage.

Chips with all gates accommodated in one package and having switching times in a tolerance range of about 0.5 ns can already be made by conventional fabrication methods. However, narrow tolerance ranges for the switching times of chips of different production series cannot be achieved with the conventional production methods. A further disadvantage of conventional microprocessor systems resides in that the switching times of different chips of the system are changed to different extents by the ambient temperature and by operating voltage fluctuations so that narrow tolerance intervals of less than 1.0 ns cannot be observed.

If chips having switching times lying in the necessary tolerance range are made by conventional methods, only a small yield is obtained from large production batches. In addition, there is a very high test expenditure which makes the chips even more expensive. However, such a fabrication method is extremely uneconomical both to the manufacturer and to the user.

The problem underlying the invention is therefore to provide a circuit arrangement which is integrated in a semiconductor substrate and the switching times of which lie within narrowly fixed tolerance limits. This problem is solved according to the invention, in one instance, by introducing a temperature sensor into a voltage control circuit responsible for producing an internal operating voltage for the digital circuit to enable the internal operating voltage to be adjusted in an inverse relation to a temperature-induced variation of the switching speed of the digital circuit. In a circuit arrangement having these features the temperature-induced influences on the switching time are eliminated so that even under relatively large changes of the use temperature of the circuit arrangement a narrow tolerance range of the switching time is maintained.

In a specific aspect, the temperature sensor may be provided by a diode included as a component in the voltage control circuit and operating in conjunction with a reference voltage source, a bipolar transistor, and an operational amplifier. The diode is connected in parallel to a resistor included as a component of a voltage divider, with the diode having a temperature sensing characteristic effective to adjust the internal operating voltage produced at the output terminal of the voltage control circuit for application to the digital circuit by providing a diode voltage inversely related to changes in temperature.

A further solution of the problem resides in the use of a complementary pair of field-effect transistors utilized in the voltage control circuit and having electrical characteristics corresponding to the electrical characteristics of corresponding components in the digital circuit in such a manner that a change in the switching speed of the components in the digital circuit due to the electrical characteristics thereof is appropriately compensated to enable an internal operating voltage to be generated by the voltage control circuit for application to the digital circuit at a constant magnitude subject to adjustment. In a circuit arrangement having these features the influences which result from the fabrication method of the integrated components in the digital circuit on the switching time are compensated.

Figure 2:
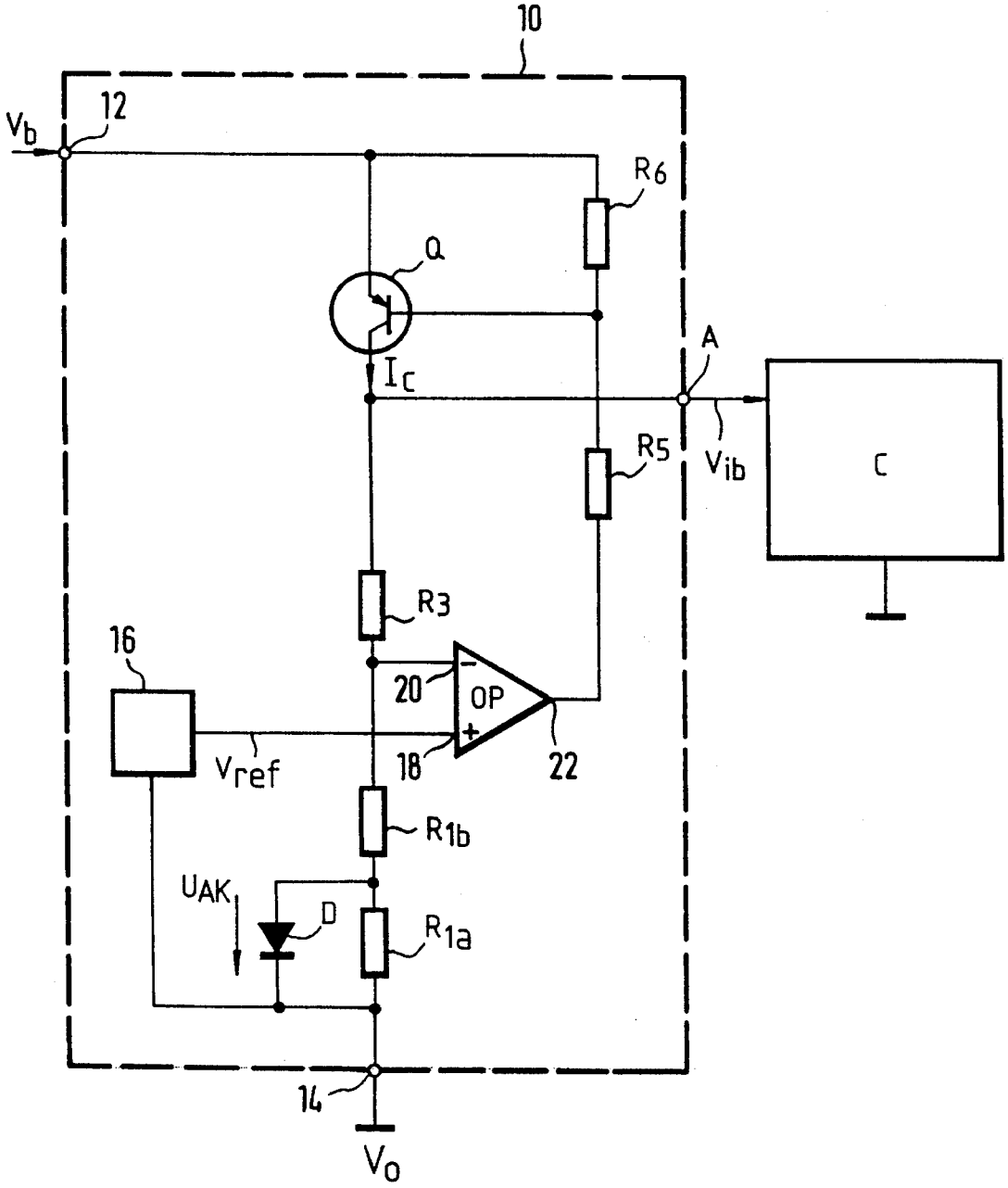
Figure 3:
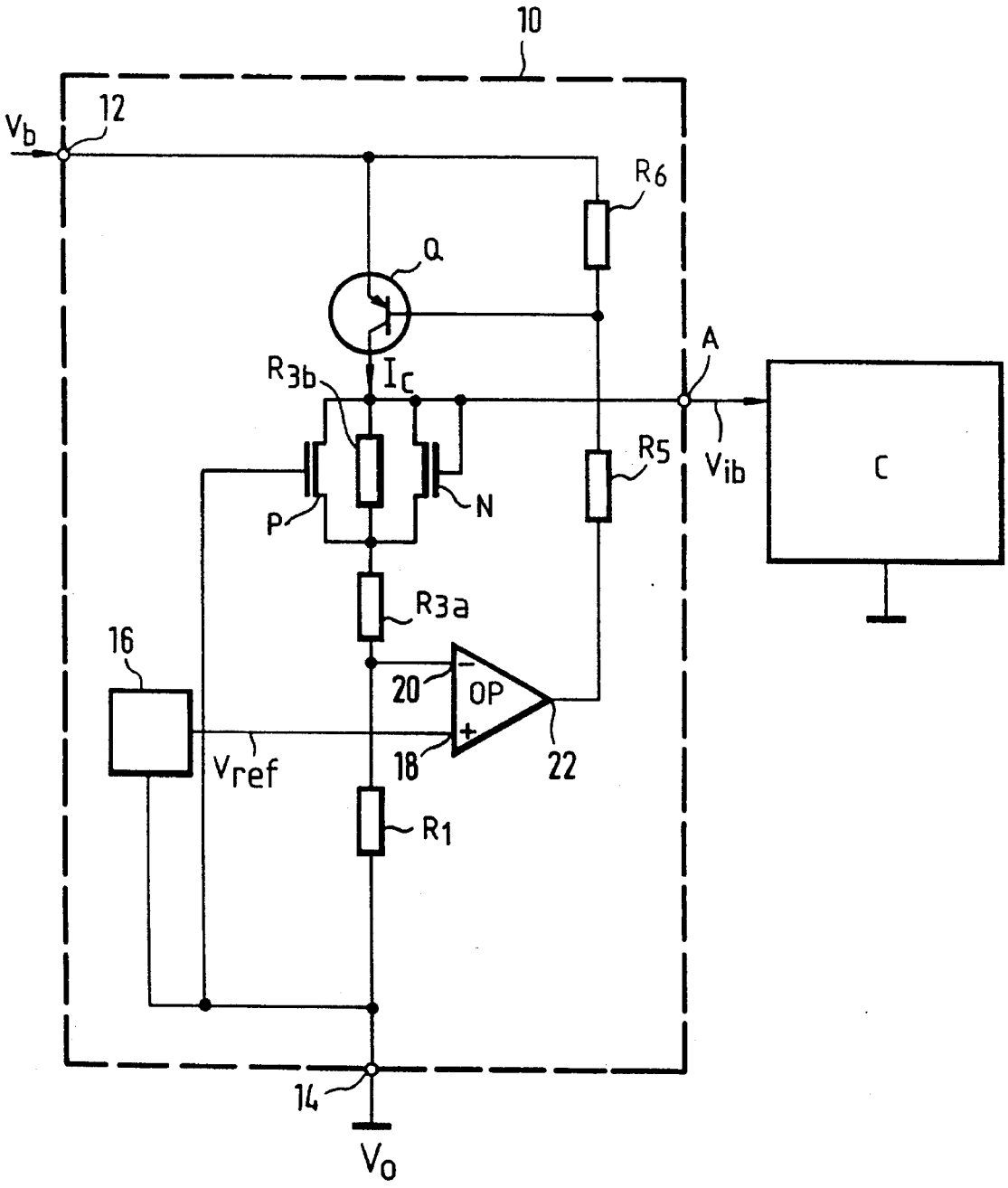
Figure 4:
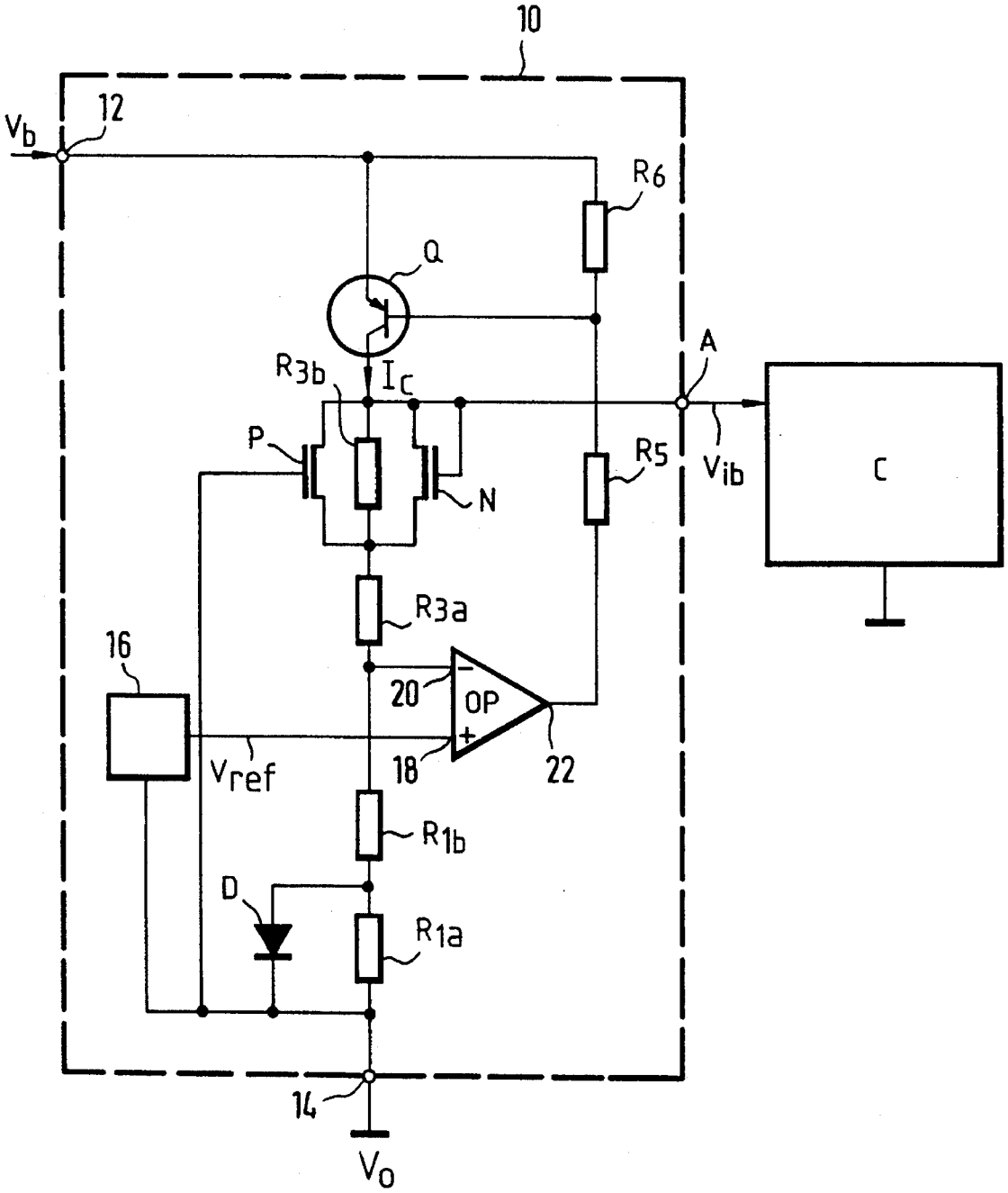

Examples of embodiment of the invention will now be explained in detail with the aid of the drawings, wherein:

FIG. 1 shows a conventional circuit for generating and maintaining an internal operating voltage, FIG. 2 shows a circuit arrangement according to the invention for compensating a temperature-induced switching time change, FIG. 3 shows a circuit arrangement according to the invention for compensating a switching time change due to fabrication process spreads, FIG. 4 shows a circuit arrangement according to the invention for compensating a switching time change caused by temperature fluctuations and by fabrication process spreads.

FIG. 1 shows a known control circuit 10 which from an external supply voltage $V_b$ generates an internal operating voltage $V_{ib}$ and maintains the latter substantially constant at an adjustable value. A control circuit of this type is described for example in "Halbleitertechnik" by U. Tietze and Ch. Schenk, Springer Verlag, 8th edition, 1986, p. 524, 525. The control circuit 10 comprises a terminal 12 for applying the external supply voltage $V_b$ and an output A. A further terminal 14 is connected to ground $V_o$. An operational amplifier OP is connected with its non-inverting input 18 to a highly exact reference voltage source 16 having a reference voltage $V_{ref}$. Such highly exact reference voltage sources are known and are described for example in "BIPOLAR AND MOS ANALOG INTEGRATED CIRCUIT DESIGN" by Alan B. Grebene, Publications John Wiley & Sons, 1984, pages 266 et seq., under the heading "Band-Gap Reference Circuits". The reference voltage $V_{ref}$ is consequently present at the non-inverting input 18. The inverting input 20 of the operational amplifier OP is connected to a voltage divider $R_1$, $R_3$. Via the resistor $R_1$ the inverting input 20 is connected on the one hand to the terminal 14 connected to ground and on the other via the resistor $R_3$ to the collector of a pnp transistor Q. The emitter of the transistor Q is connected to the terminal connected to the supply voltage $V_b$. The base of the transistor Q is connected to a further divider $R_5$, $R_6$. The one resistor $R_5$ leads to the output terminal 22 of the operational amplifier OP and the other resistor $R_6$ leads to the terminal 12 connected to the supply voltage $V_b$. The internal operating voltage $V_{ib}$ to be generated by this circuit is tapped from the collector of the transistor Q and can be supplied via the output A to a digital circuit C. The internal operating voltage $V_{ib}$ present at the output A is kept constant by the circuit described above.

The value of the operating voltage $V_{ib}$ depends on the reference voltage $V_{ref}$ and the values of the resistors $R_1$ and $R_3$.

The circuit of FIG. 1 functions in detail as follows: In the rest state, i.e. with invariable supply voltage $V_b$, the control circuit described generates, as mentioned above, the internal operating voltage $V_{ib}$ at the output A with a value dependent on the value of the reference voltage $V_{ref}$ and the value of the resistors $R_1$ and $R_3$. The control circuit continuously attempts to reduce the difference between the voltages at the two inputs 18 and 20 of the operational amplifier 22 to zero. This means that the operational amplifier OP generates at its output 22 a current which at the connection point of the two resistors $R_5$ and $R_6$ produces a voltage drop which as base voltage drives the transistor Q in such a manner that the collector $I_c$ thereof generates at the connection point of the resistors $R_1$ and $R_3$ a voltage which is equal to the reference voltage $V_{ref}$. When the supply voltage $V_b$ rises this results in a rise of the collector current $I_c$ of the transistor Q as well so that at the inverting input 20 of the operational amplifier OP a voltage is set which is greater than the reference voltage $V_{ref}$. Consequently, between the inputs 18 and 20 of the operational amplifier OP a voltage difference is present which leads to a change in the output current at the output 22. This modified output current leads to a change of the base bias of the transistor $Q_1$ such that the collector current $I_c$ thereof becomes smaller until finally the voltage drop at the inverting input 20 of the operational amplifier OP again assumes the value of the reference voltage $V_{ref}$. In this manner, the rise of the internal operating voltage $V_{ib}$ is countered by the control circuit 10 through a rise of the supply voltage $V_b$. When the Supply voltage $V_b$ drops the opposite effect occurs in that any drop of the internal operating voltage $V_{ib}$ is countered. Consequently, the control circuit 10 achieves the desired effect, i.e. of keeping the internal operating voltage $V_{ib}$ constant at a value fixed by the reference voltage $V_{ref}$ and the resistors $R_1$ and $R_3$.

FIG. 2 shows a circuit arrangement in which by subsequent regulation of the internal operating voltage the influence of the ambient temperature on the switching time is largely eliminated. This circuit arrangement corresponds substantially to the circuit arrangement of FIG. 1 and consequently the same reference numerals are used for corresponding components and circuit parts.

In contrast to the circuit arrangement of FIG. 1, in the circuit arrangement of FIG. 2 a diode D serving as temperature sensor is inserted parallel to a first part $R_{1a}$ of the resistor $R_1$ divided into two parts $R_{1a}$ and $R_{1b}$, said first part $R_{1a}$ of the resistor $R_1$ and the diode D each being connected on one side to ground. The temperature behaviour of the diode D and in particular of the diode voltage $U_{AK}$ is exactly known. With increasing temperature this diode voltage $U_{AK}$ decreases by 2 mV/° C. This effect leads on a temperature change to a change in the current flowing through the resistor $R_1$ and thus to a change of the voltage at the inverted input 20 of the operational amplifier OP.

Since the operational amplifier OP attempts to make the voltage at the inverting input 20 equal to the reference voltage $V_{ref}$, a current change in the resistor $R_{1a}$ effects a change in the output current of the operational amplifier OP and thus a change in the internal operating voltage $V_{ib}$ by influencing the collector current of the transistor Q. Now, if the temperature rises the diode voltage $U_{AK}$ drops and effects an increase in the current flowing through the resistor $R_{1a}$. Consequently, an increased current also flows through $R_{1b}$ and $R_3$ and leads to a change of the voltage at the input 20 of the operational amplifier OP. Thus, the control point of the control circuit shifts in that the internal operating voltage $V_{ib}$ is shifted to a higher value. If however the ambient temperature drops, the current flowing through $R_{1a}$ is reduced. Analogously to the process described above, this leads in the control circuit to a shift of the internal operating voltage $V_{ib}$ to lower values.

In this manner the circuit arrangement of FIG. 2 described can counter any shortening of the switching time due to temperature increase by increasing the internal operating voltage $V_{ib}$. Consequently, for such circuit arrangements narrower tolerance intervals can be set and observed.

The fluctuations of the switching time of digital circuits due to spreads of the fabrication process can be largely eliminated by means of the circuit arrangement illustrated in FIG. 3.

The circuit arrangement of FIG. 3 differs from the circuit arrangement of FIG. 1 in that the resistor $R_3$ is divided into two resistor parts $R_{3a}$ and $R_{3b}$ and that the source-drain path of a P-channel field-effect transistor P and the source-drain path of an N-channel field-effect transistor N are connected in parallel with the resistor part $R_{3b}$. The gate electrode of the P-channel field-effect transistor is connected to ground and the gate electrode of the N-channel transistor N is connected to the collector of the transistor Q and thus to the output A which furnishes the internally generated operating voltage $V_{ib}$. Both field-effect transistors are connected in this circuit as current source.

The two field-effect transistors are employed as reference components for corresponding field-effect transistors in the digital circuit C. Since they are made by the same fabrication process as the corresponding field-effect transistors in the digital circuit C, they are also subject to the same spreads of the fabrication process. These spreads lead inter alia to different channel lengths of the field-effect transistors which in turn influence the switching time of the digital circuit made. As will be apparent below from the description of the function of the circuit arrangement of FIG. 3, the two field-effect transistors P and N are inserted into the control circuit in such a manner that the changes of the switching time due to the spreads of the fabrication process are compensated by a corresponding change in the internal operating voltage $V_{ib}$ generated by the control circuit.

If in the course of the fabrication process the field-effect transistors are given channel lengths which are shorter than the desired reference length, an increased current flows through the field-effect transistors. In the digital circuit C this increased current leads to a reduction of the switching time so that the latter will possibly no longer lie in the permitted tolerance range. Since however the field-effect transistors P and N connected in parallel with the resistor part $R_{3b}$ also have shortened channels, a lower current flows through the resistor part $R_{3b}$ and consequently as this resistor part a lower voltage drop also occurs and immediately manifests itself in a reduction of the internal operating voltage $V_{ib}$. By reducing the internal operating voltage $V_{ib}$ the switching time is lengthened and therefore by the change of the internal operating voltage $V_{ib}$ the change of the switching time due to the fabrication process is counteracted. By a corresponding dimensioning of the field-effect transistors P and N and of the resistors in the control circuit a very good compensation of the switching time change can be achieved.

In the case of an increase in the channel length due to the fabrication process a corresponding compensation occurs by an increase in the internal operating voltage $V_{ib}$ because as in the case outlined above the increase in the channel length also appears in the field-effect transistors P and N.

In the circuit arrangement illustrated in FIG. 3 it is thus possible to maintain narrow tolerance limits of the switching time even in the case of spreads of the fabrication process and in particular of the channel lengths of the field-effect transistors.

In FIG. 4 a circuit arrangement is illustrated in which the possibilities of influencing the internal operating voltage $V_{ib}$ according to the circuit arrangements of FIGS. 2 and 3 are combined. This means that when using the circuit arrangement of FIG. 4 switching times with narrow tolerances can be maintained even with relatively large temperature fluctuations and relatively large spreads of the fabrication process so that the yield in the fabrication of integrated circuits or use in highspeed microprocessor systems can be considerably increased. In the circuit arrangement of FIG. 4 the same reference numerals are used as in the circuit arrangements of FIGS. 2 and 3 so that a detailed description of said circuit arrangement would be superfluous.

If in the fabrication process transistors have been made with a channel length which is too small, an increased current flows through the MOS transistors. As a result, a smaller current flows through the resistor $R_{3b}$ connected in parallel and consequently the voltage drop at the resistor $R_{3b}$ and thus the internal operating voltage potential is reduced. If a process deviation is present in the opposite direction, i.e. if the channel lengths of the MOS transistors turn out too long in the fabrication process, the current flowing through the MOS transistors drops. As a result, an increased current flows through the resistor $R_4$ and consequently the voltage drop at the resistor $R_4$ is increased and thus an increase in the internal operating potential $V_{ib}$ is achieved.

I claim:

1. A voltage control circuit for generating an internal adjustable operating voltage from an external supply voltage and maintaining the internal operating voltage at a substantially constant magnitude subject to adjustment, said voltage control circuit comprising:

an input terminal for receiving an external supply voltage;

an operational amplifier having inverting and non-inverting inputs and an output, the inverting input of said operational amplifier being connected to said input terminal;

a bipolar transistor having base, emitter and collector electrodes interconnected between said input terminal and the inverting input of said operational amplifier, the emitter electrode of said bipolar transistor being connected to said input terminal and the collector electrode of said bipolar transistor being connected to the inverting input of said operational amplifier;

a feed-back loop interconnecting the output of said operational amplifier and the base electrode of said bipolar transistor;

a reference voltage source for providing a reference voltage connected to the non-inverting input of said operational amplifier;

an output terminal connected to the collector electrode of said bipolar transistor at which the internal operating voltage for use by a digital circuit is produced;

a voltage divider having first and second serially connected resistors, the distal ends of said first and second resistors being respectively connected to the collector electrode of said bipolar transistor and to ground;

the inverting input of said operational amplifier being connected to a first node located between said first and second resistors;

said reference voltage source also being connected to ground;

said voltage divider including a third resistor connected in series to said first and second resistors and being interposed between said second resistor and ground;

a diode connected in parallel to said third resistor and having its anode connected to a second node located between said second and third resistors and its cathode connected between said reference voltage source and ground; and said diode having a temperature sensing characteristic effective to adjust the internal operating voltage produced at said output terminal by providing a diode voltage inversely related to changes in temperature.

2. A voltage control circuit as set forth in claim 1, further including a second voltage divider having fourth and fifth serially connected resistors, the distal ends of said fourth and fifth resistors of said second voltage divider being respectively connected to the emitter electrode of said bipolar transistor and to the output of said operational amplifier; and the base electrode of said bipolar transistor being connected to said second voltage divider at a node located between said fourth and fifth serially connected resistors.

3. A voltage control circuit for generating an internal adjustable operating voltage from an external supply voltage and maintaining the internal operating voltage at a substantially constant magnitude subject to adjustment, said voltage control circuit comprising:

an input terminal for receiving an external supply voltage;

an operational amplifier having inverting and non-inverting inputs and an output, the inverting input of said operational amplifier being connected to said input terminal;

a bipolar transistor having base, emitter and collector electrodes interconnected between said input terminal and the inverting input of said operational amplifier, the emitter electrode of said bipolar transistor being connected to said input terminal and the collector electrode of said bipolar transistor being connected to the inverting input of said operational amplifier;

a feed-back loop interconnecting the output of said operational amplifier and the base electrode of said bipolar transistor;

a reference voltage source for providing a reference voltage connected to the non-inverting input of said operational amplifier;

an output terminal connected to the collector electrode of said bipolar transistor at which the internal operating voltage for use by a digital circuit is produced;

a voltage divider having first and second serially connected resistors, the distal ends of said first and second resistors being respectively connected to the collector electrode of said bipolar transistor and to ground;

the inverting input of said operational amplifier being connected to a first node located between said first and second resistors;

said reference voltage source also being connected to ground;

said voltage divider including a third resistor connected in series to said first and second resistors and being interposed between said first resistor and the collector electrode of said bipolar transistor;

a complementary field-effect transistor pair having respective inputs, outputs and control gates connected in parallel with said third resistor of said voltage divider;

the control gate of one of said complementary pair of field-effect transistors being connected to ground and the control gate of the other of said pair of complementary field-effect transistors being connected to the collector electrode of said bipolar transistor and to said output terminal; and said complementary pair of field-effect transistors providing reference components for respective field-effect transistors in a digital circuit for which the internal operating voltage produced at said output terminal is intended, said complementary pair of field-effect transistors thereby compensating for changes in the switching time of the field-effect transistors included in the digital circuit by being effective to adjust the internal operating voltage produced at said output terminal.

4. A voltage control circuit as set forth in claim 3, further including a second voltage divider having fourth and fifth serially connected resistors, the distal ends of said fourth and fifth resistors being respectively connected to the emitter electrode of said bipolar transistor and the output of said operational amplifier; and the base electrode of said bipolar transistor being connected to said second voltage divider at a node located between said fourth and fifth serially connected resistors.

5. A voltage control circuit as set forth in claim 3, wherein said voltage divider further includes a fourth resistor connected in series to said first, second and third resistors and being interposed between said second resistor and ground;

a diode connected in parallel to said fourth resistor and having its anode connected to a second node located between said second and fourth resistors and its cathode connected between said reference voltage source and ground; and said diode having a temperature sensing characteristic effective to adjust the internal operating voltage produced at said output terminal by providing a diode voltage inversely related to changes in temperature.

6. An integrated circuit comprising:

a semiconductor substrate;

a digital circuit having a switching speed as between "0" and "1" logic states variable in dependence upon an internal operating voltage as applied thereto, the switching speed of said digital circuit being further subject to a temperature-induced variation thereof;

said digital circuit being disposed on said semiconductor substrate; and a voltage control circuit disposed on said semiconductor substrate with said digital circuit, said voltage control circuit having an output connected to said digital circuit for generating from an external supply voltage an internal adjustable operating voltage for application to said digital circuit and maintaining the internal operating voltage at a substantially constant magnitude subject to adjustment, said voltage control circuit including an input terminal for receiving an external supply voltage, an operational amplifier having inverting and non-inverting inputs and an output, the inverting input of said operational amplifier being connected to said input terminal, a bipolar transistor having base, emitter and collector electrodes interconnected between said input terminal and the inverting input of said operational amplifier, the emitter electrode of said bipolar transistor being connected to said input terminal and the collector electrode of said bipolar transistor being connected to the inverting input of said operational amplifier, a feed-back loop interconnecting the output of said operational amplifier and the base electrode of said bipolar transistor, a reference voltage source for providing a reference voltage connected to the non-inverting input of said operational amplifier, an output terminal connected to the collector electrode of said bipolar transistor at which the internal operating voltage is produced for input to said digital circuit, said output terminal being connected to said digital circuit, a voltage divider having first and second serially connected resistors, the distal ends of said first and second resistors being respectively connected to the collector electrode of said bipolar transistor and to ground, the inverting input of said operational amplifier being connected to a first node located between said first and second resistors, said reference voltage source also being connected to ground, said voltage divider including a third resistor connected in series to said first and second resistors and being interposed between said second resistor and ground, a diode connected in parallel to said third resistor and having its anode connected to a second node located between said second and third resistors and its cathode connected between said reference voltage source and ground, and said diode having a temperature sensing characteristic effective to adjust the internal operating voltage produced at said output terminal by providing a diode voltage inversely related to changes in temperature such that the internal operating voltage produced at said output terminal of said voltage control circuit for reception by said digital circuit varies inversely with respect to a temperature-induced variation of the switching speed of said digital circuit.

7. An integrated circuit as set forth in claim 6, wherein said voltage control circuit further includes a second voltage divider having fourth and fifth serially connected resistors, the distal ends of said fourth and fifth resistors of said second voltage divider being respectively connected to the emitter electrode of said bipolar transistor and to the output of said operational amplifier, and the base electrode of said bipolar transistor being connected to said second voltage divider at a node located between said fourth and fifth serially connected resistors.

8. An integrated circuit comprising:

a semiconductor substrate;

a digital circuit disposed on said semiconductor substrate and having a switching speed as between "0" and "1" logic states variable in dependence upon an internal operating voltage as applied thereto; and a voltage control circuit disposed on said semiconductor substrate with said digital circuit, said voltage control circuit having an output connected to said digital circuit for generating from an external supply voltage an internal adjustable operating voltage for application to said digital circuit and maintaining the internal operating voltage at a substantially constant magnitude subject to adjustment, said voltage control circuit including an input terminal for receiving an external supply voltage, an operational amplifier having inverting and non-inverting inputs and an output, the inverting input of said operational amplifier being connected to said input terminal, a bipolar transistor having base, emitter and collector electrodes interconnected between said input terminal and the inverting input of said operational amplifier, the emitter electrode of said bipolar transistor being connected to said input terminal and the collector electrode of said bipolar transistor being connected to the inverting input of said operational amplifier, a feed-back loop interconnecting the output of said operational amplifier and the base electrode of said bipolar transistor, a reference voltage source for providing a reference voltage connected to the non-inverting input of said operational amplifier, an output terminal connected to the collector electrode of said bipolar transistor at which the internal operating voltage is produced for input to said digital circuit, said output terminal being connected to said digital circuit, a voltage divider having first and second serially connected resistors, the distal ends of said first and second resistors being respectively connected to the collector electrode of said bipolar transistor and to ground, the inverting input of said operational amplifier being connected to a first node located between said first and second resistors, said reference voltage also being connected to ground, said voltage divider including a third resistor connected in series to said first and second resistors and being interposed between said first resistor and the collector electrode of said bipolar transistor, a complementary field-effect transistor pair having respective inputs, outputs and control gates connected in parallel with said third resistor of said voltage divider, the control gate of one of said complementary pair of field-effect transistors being connected to ground and the control gate of the other of said pair of complementary field-effect transistors being connected to the collector electrode of said bipolar transistor and to said output terminal; and the electrical characteristics of said complementary pair of field-effect transistors corresponding to the electrical characteristics of corresponding components in said digital circuit such that the internal operating voltage produced at said output terminal of said voltage control circuit changes in a direction compensating for a change in the switching speed of said digital circuit caused by the electrical characteristics of the components in said digital circuit.

9. An integrated circuit as set forth in claim 8, wherein said voltage control circuit further includes a second voltage divider having fourth and fifth serially connected resistors, the distal ends of said fourth and fifth resistors being respectively connected to the emitter electrode of said bipolar transistor and the output of said operational amplifier, and the base electrode of said bipolar transistor being connected to said second voltage divider at a node located between said fourth and fifth serially connected resistors.

10. An integrated circuit as set forth in claim 8, wherein said voltage divider further includes a fourth resistor connected in series to said first, second and third resistors and being interposed between said second resistor and ground, a diode connected in parallel to said fourth resistor and having its anode connected to a second node located between said second and fourth resistors and its cathode connected between said reference voltage source and ground, and said diode having a temperature sensing characteristic effective to adjust the internal operating voltage produced at said output terminal by providing a diode voltage inversely related to changes in temperature such that the internal operating voltage produced at said output terminal of said voltage control circuit for reception by said digital circuit varies inversely with respect to a temperature-induced variation of the switching speed of said digital circuit.

11. An integrated circuit as set forth in claim 8, wherein said complementary pair of field-effect transistors included in said voltage control circuit comprise a P-channel field-effect transistor and an N-channel field-effect transistor constructed simultaneously with corresponding components in said digital circuit in accordance with the same process steps.

* * * * *